US012035759B2

(12) United States Patent
Qin

(10) Patent No.: US 12,035,759 B2
(45) Date of Patent: Jul. 16, 2024

(54) CLIPPING EXTENDER FOR NURSING BRA AND NURSING BRA

(71) Applicant: Shenzhen Lutejiacheng Technology Co., Ltd., Shenzhen (CN)

(72) Inventor: E Qin, Shenzhen (CN)

(73) Assignee: SHENZHEN LUTEJIACHENG TECHNOLOGY CO., LTD., Shenzhen (CN)

( * ) Notice: Subject to any disclaimer, the term of this patent is extended or adjusted under 35 U.S.C. 154(b) by 126 days.

(21) Appl. No.: 17/842,833

(22) Filed: Jun. 17, 2022

(65) Prior Publication Data

US 2023/0284710 A1 Sep. 14, 2023

(30) Foreign Application Priority Data

Mar. 14, 2022 (CN) ..... 202210249778.0

(51) Int. Cl.
*A41C 3/04* (2006.01)
*A41C 3/00* (2006.01)

(52) U.S. Cl.
CPC ..... *A41C 3/04* (2013.01); *A41C 3/0028* (2013.01)

(58) Field of Classification Search
CPC ..... A41C 3/04; A41C 3/0028
USPC ..... 450/86
See application file for complete search history.

(56) References Cited

U.S. PATENT DOCUMENTS 1,936,127 A * 11/1933 Dunlevy ..... A41F 15/002 2/323
2,109,345 A * 2/1938 Silverman ..... A41F 15/002 2/323
2,502,524 A * 4/1950 Keller ..... A41C 3/04 D2/709
2,522,010 A * 9/1950 Woodruff ..... A41C 3/04 D2/709
2,529,774 A * 11/1950 Landau ..... A41B 9/16 2/323
2,657,392 A * 11/1953 Jackson ..... A41F 15/00 2/338
2,748,771 A * 6/1956 Richards ..... A41C 3/04 450/36
2,767,402 A * 10/1956 Pauk ..... A41C 3/04 604/385.07
2,849,723 A * 9/1958 Marino ..... A41F 15/005 2/337
D383,888 S * 9/1997 Smith ..... D2/624
6,163,937 A * 12/2000 McKinnis ..... A41F 15/02 2/323
6,179,687 B1 * 1/2001 Lee ..... A41F 15/002 450/88

(Continued)

*Primary Examiner* — Gloria M Hale
(74) *Attorney, Agent, or Firm* — Bayramoglu Law Offices LLC

(57) ABSTRACT

A clipping extender for a nursing bra and the nursing bra are provided. The clipping extender for the nursing bra includes an extension strap and a first back clip. The extension strap is made of an elastic for providing an extended length. One end of the extension strap is fixedly connected to the first back clip, and the first back clip is configured to detachably connect a front clip of the nursing bra. To pump milk, the nursing mom wearing the nursing bra only needs to connect the clipping extender to the back and front clips of the nursing bra to increase the space between the nursing bra and the body for placing the portable breast pump.

19 Claims, 4 Drawing Sheets

(56) References Cited

U.S. PATENT DOCUMENTS

| | | | | |
|---|---|---|---|---|
| 6,186,861 | B1 * | 2/2001 | Flaherty | A41F 15/002 450/86 |
| 6,346,027 | B1 * | 2/2002 | Merkovsky | A41C 3/04 450/38 |
| 6,422,521 | B1 * | 7/2002 | Tinklepaugh | B60T 17/046 24/301 |
| 7,081,034 | B1 * | 7/2006 | Zoellner | A41C 3/04 2/104 |
| 7,314,400 | B2 * | 1/2008 | Fildan | A41F 15/002 450/86 |
| 9,345,274 | B1 * | 5/2016 | Prill | A41D 1/215 |
| 10,420,378 | B2 * | 9/2019 | Kosak | A61M 1/067 |
| 10,426,203 | B2 * | 10/2019 | Kosak | A41C 3/04 |
| 2012/0184179 | A1 * | 7/2012 | Blitz | A61M 1/067 450/36 |
| 2018/0352884 | A1 * | 12/2018 | Vanos | A41F 1/006 |
| 2020/0383393 | A1 * | 12/2020 | Caden | B32B 27/40 |
| 2021/0084996 | A1 * | 3/2021 | Ironi | A41C 3/04 |

* cited by examiner

CLIPPING EXTENDER FOR NURSING BRA AND NURSING BRA

CROSS REFERENCE TO THE RELATED APPLICATIONS

This application is based upon and claims priority to Chinese Patent Application No. 202210249778.0, filed on Mar. 14, 2022, the entire contents of which are incorporated herein by reference.

TECHNICAL FIELD

The present disclosure relates to the technical field of nursing bras, and in particular to a clipping extender for a nursing bra and the nursing bra.

BACKGROUND

Because of the high nutritional value of breast milk, medical practitioners recommend mothers to breastfeed their babies. To ensure the baby's feedings, working moms usually bring related devices to the workplace for a series of processes such as milk pumping, storage and refrigeration for getting the milk home to feed their babies. The existing nursing bras generally use a single nursing clip, which can be directly unhooked for breastfeeding. However, due to the limited space between the nursing bra and the body, it is not possible to place a portable breast pump to pump milk while working.

SUMMARY

To solve the above-mentioned problem, the present disclosure adopts the following technical solutions:

A clipping extender for a nursing bra includes:

an extension strap and a first back clip, where the extension strap is made of an elastic for providing an extended length; and one end of the extension strap is fixedly connected to the first back clip, and the first back clip is configured to detachably connect a front clip of the nursing bra.

Preferably, the clipping extender for the nursing bra further may include a first front clip; and the first front clip may be fixedly connected to the other end of the extension strap, and may be configured to detachably connect a back clip of the nursing bra.

Preferably, the other end of the extension strap may be fixedly connected to the back clip of the nursing bra, and the first back clip may be fixedly connected to the nursing bra.

Preferably, the extension strap may be provided with an adjuster for adjusting a length of the extension strap.

The present disclosure further provides a nursing bra, including:

a clipping extender for the nursing bra, and a bra body, where the clipping extender for the nursing bra is connected to the bra body;

a front side of the bra body is provided with two cup structures; each of the cup structures is formed by adhering an outer fabric and an inner fabric along a breast contour; and the outer fabric is located outside the front side of the bra body, and the inner fabric is located inside the front side of the bra body;

straps and the cup structures of the bra body are connected or disconnected through nursing clips; and the straps of the bra body are detachably connected to top ends of a back side of the bra body.

Preferably, the bra body further may include pads, and the pads may be teardrop-shaped to shape breasts and prevent nipple show-through.

Preferably, the cup structures may be provided with accommodating spaces and openings; the accommodating spaces have a shape matched with the pads; and the pads may be put in or taken out through the openings.

Preferably, the pads may be semi-fixed to lower edges of the accommodating spaces.

Preferably, the bra body further may include slings; and each of the slings may have one end fixedly connected to the nursing clip or the first back clip and the other end fixedly connected to a bottom of the bra body, and may be configured to connect and stabilize the strap.

Preferably, the bra body further may include a W-shaped support; and the W-shaped support may be provided inside sides and a bottom of the bra body along an outer contour of the cup structures, and may be configured to support the cup structures.

Preferably, the back side of the bra body may be provided with clasps, and the clasps may be configured to connect or disconnect the back side of the bra body.

Preferably, the back side of the bra body further may include back strengthening bars, and the back strengthening bars may be located on an inner side of the back side of the bra body; and each of the back strengthening bars may have one end fixedly connected to a joint between the strap and the back side of the bra body and the other end fixedly connected to a bottom of the back side of the bra body, and may be configured to improve a structural strength of the back side of the bra body.

The present disclosure has the following beneficial effects. To pump milk, the nursing mom wearing the nursing bra of the present disclosure only needs to connect the clipping extender to the back and front clips of the nursing bra to increase the space between the nursing bra and the body for placing the portable breast pump.

REFERENCE NUMERALS

1. extension strap; 2. first back clip; 3. first front clip; 4. adjuster; 5. cup structure; 51. outer fabric; 52. inner fabric; 53. accommodating space; 54. opening; 6. strap; 7. nursing clip; 8. pad; 9. sling; 10. W-shaped support; 11. left side panel; 12. right side panel; 13. center panel; 14. back side of nursing bra; 15. clasp; and 16. back strengthening bar.

DETAILED DESCRIPTION OF THE EMBODIMENTS

The present disclosure is further described in detail below with reference to the drawings and embodiments of the present disclosure.

Embodiment 1

A clipping extender for a nursing bra includes an extension strap (1) and a first back clip (2).

The extension strap (1) is made of an elastic for providing an extended length.

One end of the extension strap (1) is fixedly connected to the first back clip (2), and the first back clip (2) is configured to detachably connect a front clip of the nursing bra.

In this embodiment, the clipping extender for the nursing bra is composed of an extension strap (1) and a first back clip (2). The extension strap (1) has to bear a certain tensile force, so the extension strap (1) is made of an elastic, in particular a braided nylon strap. The first back clip (2) is matched with the front clip of the nursing bra. When a portable breast pump is used, the front clip of the nursing bra is hooked to the first back clip (2). After pumping, the portable breast pump is removed, and the front clip of the nursing bra is unhooked from the first back clip (2).

Embodiment 2

In this embodiment, as a further improvement of the technical solution of Embodiment 1, the clipping extender for the nursing bra further includes a first front clip (3). The first front clip (3) is fixedly connected to the other end of the extension strap (1), and is configured to detachably connect a back clip of the nursing bra. The first front clip (3) is matched with the back clip of the nursing bra. When a portable breast pump is used, the first front clip (3) is hooked to the back clip of the nursing bra. After pumping, the portable breast pump is removed, and the first front clip (3) is unhooked from the back clip of the nursing bra.

Embodiment 3

In this embodiment, as a further improvement of the technical solution of Embodiment 1, the other end of the extension strap (1) is fixedly connected to the back clip of the nursing bra, in particular by sewing. The first back clip (2) is fixedly connected to the nursing bra, in particular by sewing. When a portable breast pump is used, the front clip of the nursing bra is unhooked from the back clip of the nursing bra, and is hooked to the first back clip (2). After pumping, the portable breast pump is removed, the front clip of the nursing bra is unhooked from the first back clip (2), and hooked to the front clip of the nursing bra.

Embodiment 4

Figure 1:
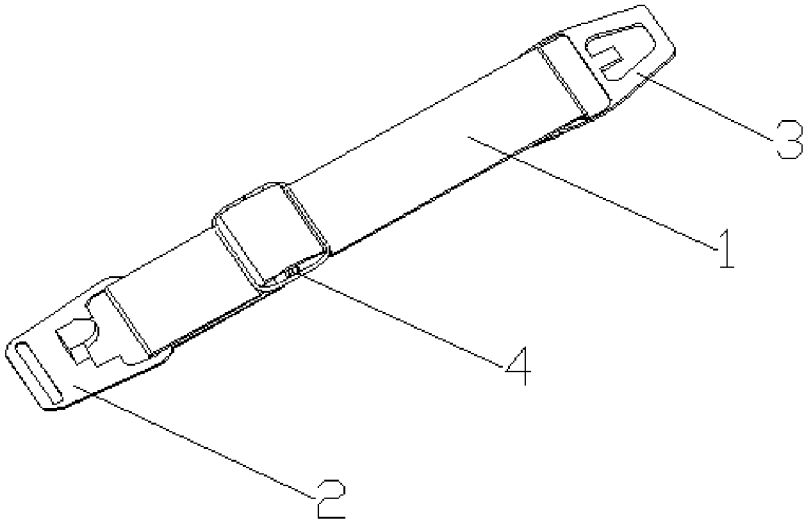
FIG. 1 is a three-dimensional view of a clipping extender for a nursing bra according to the present disclosure.
Figure 2:
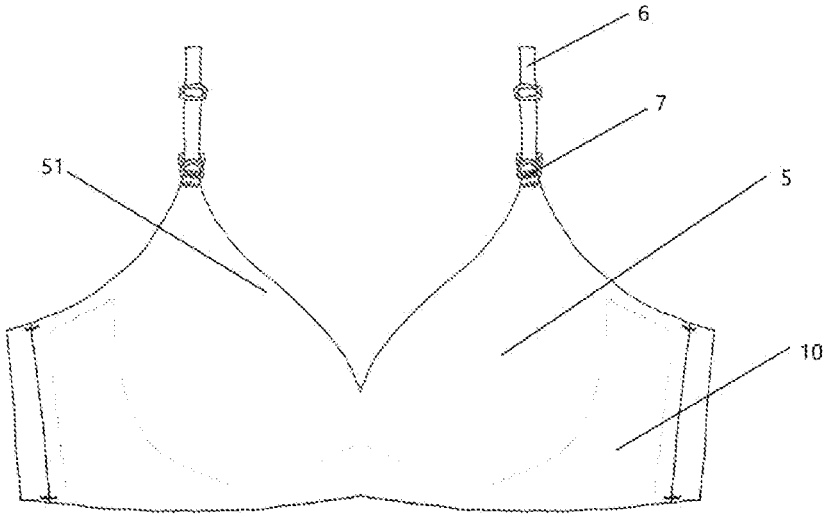
FIG. 2 is an outside view of a front side of the nursing bra according to the present disclosure.
Figure 3:
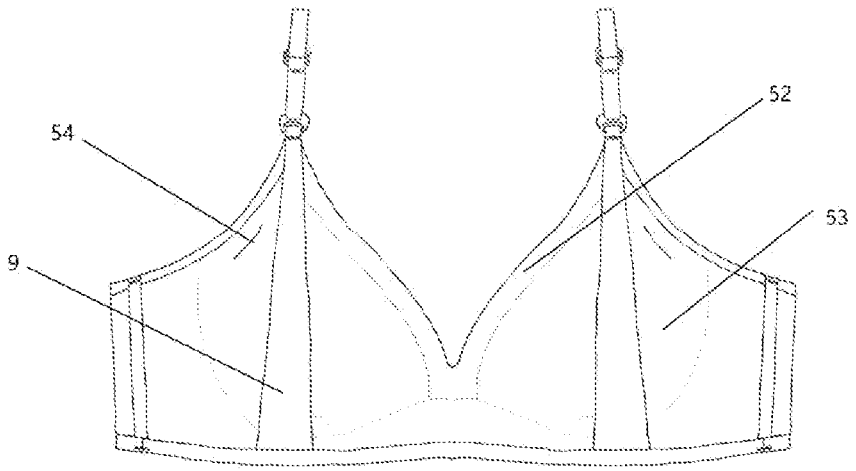
FIG. 3 is an inside view of the front side of the nursing bra according to the present disclosure.
Figure 4:
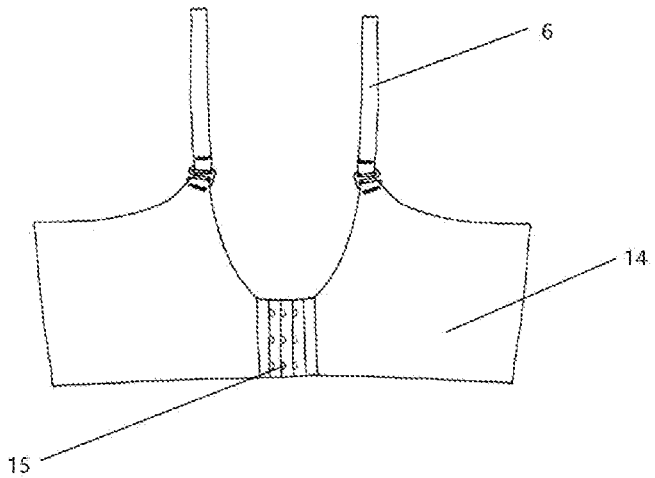
FIG. 4 is an outside view of a back side of the nursing bra according to the present disclosure.
Figure 5:
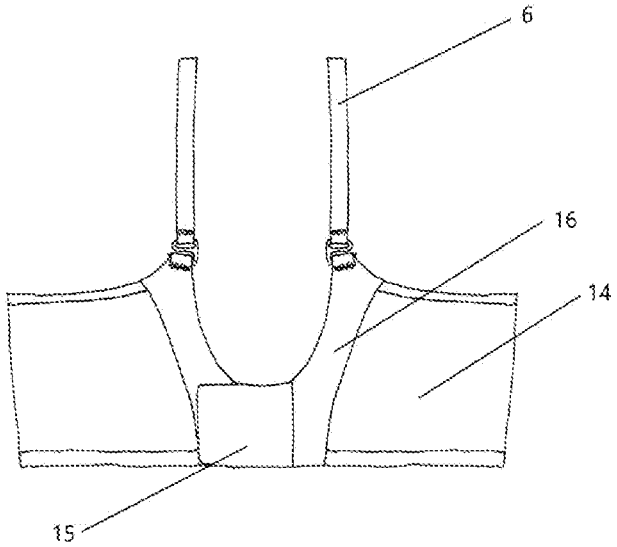
FIG. 5 is an inside view of the back side of the nursing bra according to the present disclosure.
Figure 6:
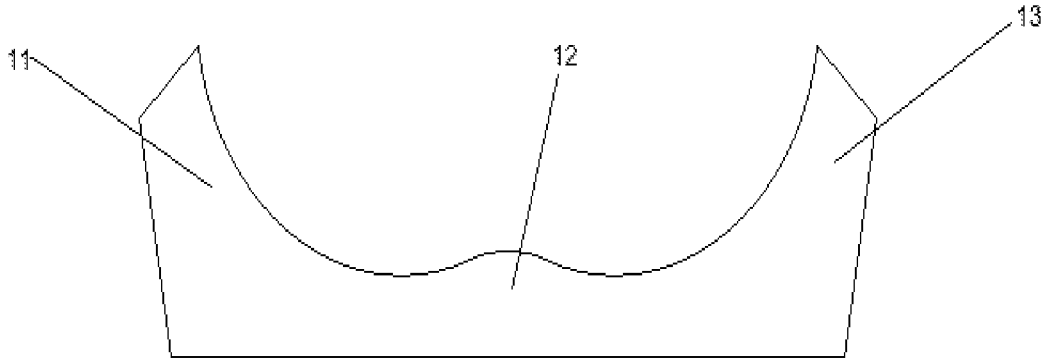
FIG. 6 is a structural view of a W-shaped support of the nursing bra according to the present disclosure.
Figure 7:
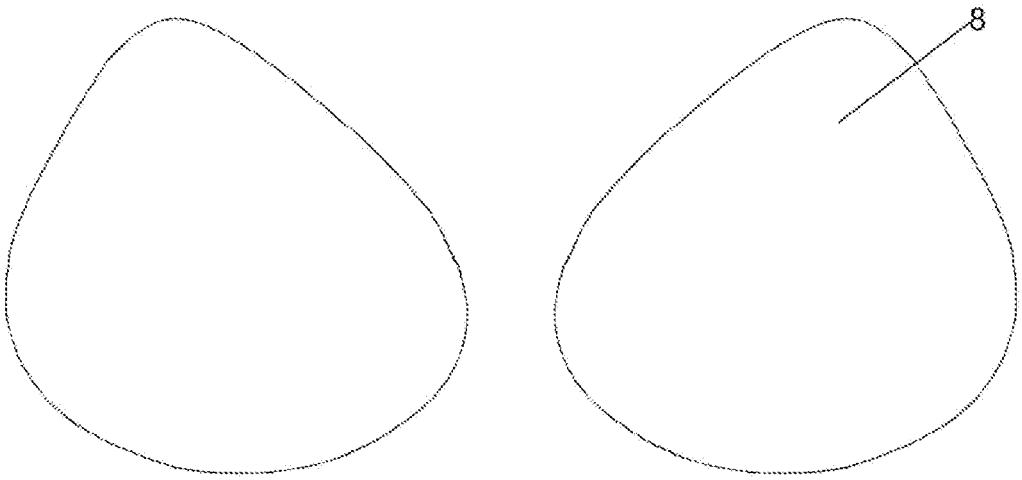
FIG. 7 is a structural view of pads of the nursing bra according to the present disclosure.
Figure 8:
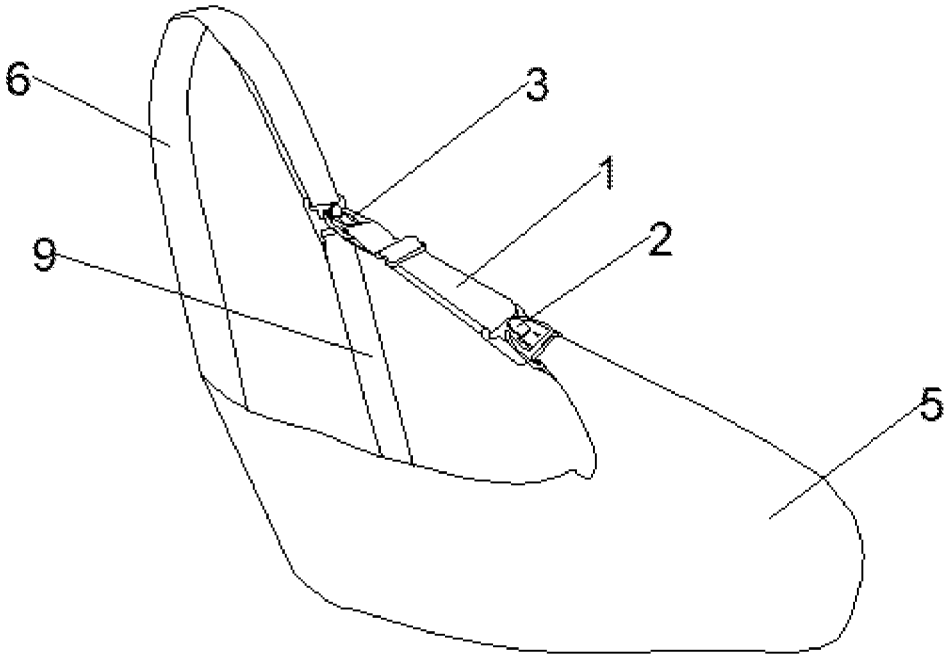
FIG. 8 is a three-dimensional view of the clipping extender matched with the nursing bra according to the present disclosure.

In this embodiment, as a further improvement of the technical solutions of Embodiments 1 to 3, the extension strap (1) is provided with an adjuster (4) for adjusting a length of the extension strap (1). Nursing women's breasts vary in size and therefore require different space between the breasts and the bra. The adjuster (4) facilitates the insertion of a portable breast pump to pump milk and makes the breast comfortable. Further, the adjuster (4) is a figure 8-shaped clip.

Embodiment 5

In this embodiment, a nursing bra includes a clipping extender for the nursing bra, and a bra body. The clipping extender for the nursing bra is connected to the bra body.

A front side of the bra body is provided with two cup structures (5). Each of the cup structures (5) is formed by adhering an outer fabric (51) and an inner fabric (52) along a breast contour. The outer fabric (51) is located outside the front side of the bra body, and the inner fabric (52) is located inside the front side of the bra body. The breasts of nursing women will change in size in a short period of time, so the outer fabric (51) and the inner fabric (52) are made of elastics.

Straps (6) and the cup structures (5) of the bra body are connected or disconnected through nursing clips (7). Nursing women only need to unclip the nursing clip (7) to breastfeed their babies.

The straps (6) of the bra body are detachably connected to top ends of a back side (14) of the bra body.

Embodiment 6

In this embodiment, as a further improvement of the technical solution of Embodiment 5, the bra body further includes pads (8). The pads (8) are teardrop-shaped, and are made of a comfortable, breathable soft material to shape the breasts and prevent nipple show-through.

Embodiment 7

In this embodiment, as a further improvement of the technical solutions of Embodiments 5 and 6, the cup structures (5) are provided with accommodating spaces (53) and openings (54). The accommodating spaces (53) have a shape matched with the pads (8), and the pads (8) are put in or taken out through the openings (54). Further, the opening (54) is provided in the inner fabric (52), close to a side edge of the bra body, and has a length of 3.5-4 cm. Nursing women will spring a leak, which will stain the bra. To thoroughly clean the pads (8), the pads (8) are taken out of the accommodating spaces (53) through the openings (54).

Embodiment 8

In this embodiment, as a further improvement of the technical solutions of Embodiments 6 and 7, the pad (8) is semi-fixed to a lower edge of the accommodating space (53).

Further, the pad (8) is fixed by adhering. Nursing women's breasts expand by 20%-30% in 2-3 hours. The cup structure (5) is made of an elastic, and the pad (8) is inserted. If the pad is fully fixed, it will limit the stretch of the cup structure (5), thereby squeezing the expanded breast and causing breast pain. If the pad is not fixed, the pad (8) will shift and curl during washing and wearing, which affects the convenience and comfort of the nursing bra. When the nursing bra is washed, the pad (8) will curl at a contact point between the elastic cup structure (5) and a W-shaped support (10). The lower edge of the cup structure (5) has a small curvature. Therefore, the pad (8) is adhered to the lower edge of the accommodating space (53) in the cup structure (5), thereby increasing the adhesion area and making the pad (8) stable.

Embodiment 9

In this embodiment, as a further improvement of the technical solution of Embodiment 5, the bra body further includes slings (9). Each of the slings (9) has one end fixedly connected to the nursing clip (7) or the first back clip (2) and the other end fixedly connected to a bottom of the bra body, and is configured to connect and stabilize the strap. Further, the slings (9) are made of an elastic and a wide structure, preventing the slings (9) from compressing and bruising the breasts. An end of the sling (9) connected to the bottom of the bra body is widened to increase the connection area. In this way, the pulling force of the sling (9) to the bottom of the bra body is evenly distributed, thereby reducing the deformation of the joint at the bottom of the bra body.

Embodiment 10

In this embodiment, as a further improvement of the technical solution of Embodiment 5, the bra body further includes a W-shaped support (10). The W-shaped support (10) is provided inside sides and a bottom of the bra body along an outer contour of the cup structures (5), and is configured to support the cup structures (5).

In order to increase the wearing stretch and comfort of the nursing bra, the cup structures (5) of the nursing bra are made of an elastic fabric. However, the elastic fabric cannot provide enough support for the breasts. Therefore, in this embodiment, the W-shaped support (10) replaces the steel or plastic underwires used in general nursing bras to support the breasts, and will not pinch the breasts. A left side panel (11) and a center panel (13) of the W-shaped support are widened and raised to wrap the outer sides of the cup structures (5) to prevent the breasts from spreading laterally to gather the breasts. A right side panel (12) of the W-shaped support is lowered to spare room for an elastic fabric to connect the two cup structures (5). When the breasts continue to expand within 2-3 hours, the nursing bra can stretch laterally to expand the space, thereby ensuring wearing comfort.

Embodiment 11

In this embodiment, as a further improvement of the technical solution of Embodiment 5, the back side (14) of the bra body is provided with clasps (15). The clasps (15) are configured to connect or disconnect the back side (14) of the bra body to facilitate putting on and taking off the nursing bra.

Embodiment 12

In this embodiment, as a further improvement of the technical solution of Embodiment 5, the back side (14) of the bra body further includes back strengthening bars (16). The back strengthening bars (16) are located on an inner side of the back side (14) of the bra body. Each of the back strengthening bars has one end fixedly connected to a joint between the strap (6) and the back side (14) of the bra body and the other end fixedly connected to a bottom of the back side (14) of the bra body. The back strengthening bars are configured to improve the structural strength of the back side of the bra body, reduce breakage and deformation, and avoid bruises.

In the description of the present disclosure, it should be understood that terms such as "upper", "lower", "front", "rear", "left", "right", "vertical", "horizontal", "top", "bottom", "top portion", "bottom portion", "inside", "outside", "inner side" and "outer side" are intended to indicate the orientation or position relationships based on the drawings. They are merely intended to facilitate and simplify the description of the present disclosure, rather than to indicate or imply that the mentioned device or components must have the specific orientation or must be constructed and operated in the specific orientation. Therefore, these terms should not be understood as a limitation to the present disclosure. The "inside" refers to an interior or enclosed region or space, and the "outside" refers to a region surrounding a particular component or particular region.

In the description of the embodiments of the present disclosure, the terms such as "first", "second", "third" and "fourth" are used only for the purpose of description, rather than to imply relative importance or implicitly indicate a quantity of the technical features. Therefore, the features defined by the terms "first", "second", "third" and "fourth" may explicitly or implicitly include one or more of the features. In the description of the present disclosure, unless otherwise specified, "multiple" means at least two.

It should be understood that, in the description of the embodiments of the present disclosure, unless otherwise specified, the phrases "provided with", "connected", "connection" and "assembled" should be comprehended in a broad sense. For example, "connection" may be a fixed connection, a detachable connection or an integrated connection, may be a direct connection or an indirect connection via a medium, or may be intercommunication between two components. Those of ordinary skill in the art may understand the specific meanings of the above terms in the present disclosure based on the specific situation.

In the description of the embodiments of the present disclosure, the specific features, structures, materials or characteristics may be combined in any suitable manner in any one or more embodiments or examples.

It should be understood that, in the description of the embodiments of the present disclosure, "-" and "to" are used to represent a range between two numerical values, and the range includes the endpoints. For example: "A-B" means a range greater than or equal to A and less than or equal to B, and "A to B" means the range greater than or equal to A and less than or equal to B.

It should be understood that, in the description of the embodiments of the present disclosure, the term "and/or" merely describes associations between associated objects, and it indicates three types of relationships. For example, A and/or B may indicate that A alone, A and B, or B alone. In addition, the character "/" in this specification generally indicates that the associated objects are in an "or" relationship.

Although the embodiments of the present disclosure are described above, it should be understood that those of ordinary skill in the art may make various changes, modifications, replacements and variations to these embodiments without departing from the principle and spirit of the present disclosure, and the scope of the present disclosure is subjected to the appended claims and legal equivalents thereof.

What is claimed is:

1. A clipping extender for a nursing bra, comprising:

an extension strap; and a back clip fixedly connected to a first end of the extension strap;

wherein the extension strap is made of an elastic for providing an extended length; and the back clip fixedly connected to the first end of the extension strap is configured to detachably connect a front clip of the nursing bra.

2. The clipping extender for the nursing bra according to claim 1, further comprising a front clip fixedly connected to a second end of the extension strap; wherein the front clip fixedly connected to the second end of the extension strap is configured to detachably connect a back clip of the nursing bra.

3. The clipping extender for the nursing bra according to claim 1, wherein a second end of the extension strap is fixedly connected to a back clip of the nursing bra, and the back clip fixedly connected to the first end of the extension strap is fixedly connected to the nursing bra.

4. The clipping extender for the nursing bra according to claim 1, wherein the extension strap is provided with an adjuster for adjusting a length of the extension strap.

5. A nursing bra, comprising the clipping extender for the nursing bra according to claim 1, and a bra body, wherein the clipping extender for the nursing bra is connected to the bra body;

a front side of the bra body is provided with two cup structures; each of the two cup structures is formed by adhering an outer fabric and an inner fabric along a breast contour; and the outer fabric is located outside the front side of the bra body, and the inner fabric is located inside the front side of the bra body;

each of straps and each of the two cup structures of the bra body are connected or disconnected through each of nursing clips; and the straps of the bra body are detachably connected to top ends of a back side of the bra body.

6. The nursing bra according to claim 5, wherein the bra body further comprises pads, and the pads are teardrop-shaped to shape breasts and prevent nipple show-through.

7. The nursing bra according to claim 6, wherein the two cup structures are provided with accommodating spaces and openings; the accommodating spaces have a shape matched with the pads; and the pads are put in or taken out through the openings.

8. The nursing bra according to claim 7, wherein the pads are semi-fixed to lower edges of the accommodating spaces.

9. The nursing bra according to claim 5, wherein the bra body further comprises slings; and each of the slings has a first end fixedly connected to each of the nursing clips or the back clip fixedly connected to the first end of the extension strap and a second end fixedly connected to a bottom of the bra body, and each of the slings is configured to connect and stabilize each of the straps.

10. The nursing bra according to claim 5, wherein the bra body further comprises a W-shaped support; and the W-shaped support is provided inside sides and a bottom of the bra body along an outer contour of the two cup structures, and the W-shaped support is configured to support the two cup structures.

11. The nursing bra according to claim 5, wherein the back side of the bra body is provided with clasps, and the clasps are configured to connect or disconnect the back side of the bra body.

12. The nursing bra according to claim 5, wherein the back side of the bra body further comprises back strengthening bars, and the back strengthening bars are located on an inner side of the back side of the bra body; and each of the back strengthening bars has a first end fixedly connected to a joint between each of the straps and the back side of the bra body and a second end fixedly connected to a bottom of the back side of the bra body, and each of the back strengthening bars is configured to improve a structural strength of the back side of the bra body.

13. The clipping extender for the nursing bra according to claim 2, wherein the extension strap is provided with an adjuster for adjusting a length of the extension strap.

14. The clipping extender for the nursing bra according to claim 3, wherein the extension strap is provided with an adjuster for adjusting a length of the extension strap.

15. The nursing bra according to claim 5, wherein the clipping extender for the nursing bra further comprises a front clip fixedly connected to a second end of the extension strap; wherein the front clip fixedly connected to the second end of the extension strap is configured to detachably connect a back clip of the nursing bra.

16. The nursing bra according to claim 5, wherein a second end of the extension strap is fixedly connected to a back clip of the nursing bra, and the back clip fixedly connected to the first end of the extension strap is fixedly connected to the nursing bra.

17. The nursing bra according to claim 5, wherein the extension strap is provided with an adjuster for adjusting a length of the extension strap.

18. The nursing bra according to claim 6, wherein the two cup structures are provided with accommodating spaces and openings; the accommodating spaces have a shape matched with the pads; and the pads are put in or taken out through the openings.

19. The nursing bra according to claim 7, wherein the pads are semi-fixed to lower edges of the accommodating spaces.

* * * * *